United States Patent [19]

Lomax et al.

[11] Patent Number: 5,023,145

[45] Date of Patent: Jun. 11, 1991

[54] MULTI CARBIDE ALLOY FOR BIMETALLIC CYLINDERS

[75] Inventors: Donald P. Lomax, Wales; Gregory N. Patzer; Giri Rajendran, both of Waukesha, all of Wis.

[73] Assignee: Bimex Corporation, Wales, Wis.

[21] Appl. No.: 397,033

[22] Filed: Aug. 21, 1989

[51] Int. Cl.[5] ..... C22C 32/00

[52] U.S. Cl. ..... 428/614

[58] Field of Search ..... 428/614

[56] References Cited

U.S. PATENT DOCUMENTS 3,532,148 10/1970 Kolbl ..... 75/236

4,330,333 5/1982 Gibbs ..... 75/236

FOREIGN PATENT DOCUMENTS 869575 4/1971 Canada .

*Primary Examiner*—Theodore Morris

*Assistant Examiner*—David W. Schumaker

*Attorney, Agent, or Firm*—Frost & Jacobs

[57] ABSTRACT

The present invention relates to alloys having substantially uniform aggregate distribution, a method of making such alloys, and centrifigally cast members made from such alloys. The alloys of the present invention utilize aggregates of tungsten carbide, vanadium carbide and titanium carbide so formulated to allow them to be uniformly distributed throughout the alloy matrix.

5 Claims, 3 Drawing Sheets

△ - DENOTES TUNGSTEN CARBIDE

○ - DENOTES TITANIUM CARBIDE OR OTHER CARBIDES

⬡ - DENOTES VANADIUM CARBIDE

△- DENOTES TUNGSTEN CARBIDE
o - DENOTES TITANIUM CARBIDE OR OTHER CARBIDES
O- DENOTES VANADIUM CARBIDE

△ – DENOTES TUNGSTEN CARBIDE
o – DENOTES TITANIUM CARBIDE OR OTHER CARBIDES
O – DENOTES VANADIUM CARBIDE

△ – DENOTES TUNGSTEN CARBIDE
○ – DENOTES TITANIUM CARBIDE OR OTHER CARBIDES
⬡ – DENOTES VANADIUM CARBIDE

MULTI CARBIDE ALLOY FOR BIMETALLIC CYLINDERS

FIELD OF INVENTION

This invention relates generally to hard wear and corrosion resistant alloys and more specifically to alloys for use in bimetallic linings for steel cylinders and the like, such as those employed in extrusion and injection molding equipment.

BACKGROUND OF INVENTION

A steady increase in the use of aggressive fillers and additives to enhance the properties of materials being processed in injection and extrusion molding applications has led to increased wear of conventional iron and nickel based alloy bimetallic lining materials used in injection and extrusion molding equipment.

As a result of this, a carbide bearing alloy providing better resistance to these fillers and additives was developed and because the subject of U. S. Pat. No. 3,836,341. This new alloy contained tungsten carbide particles which were differentially dispersed through the thickness of the bimetallic lining. The differential distribution of the carbides, combined with the fact the tungsten carbide particles are angular in configuration, was said to produce uneven wear rates of bimetallic lining, as well as create a "sandpaper" like effect on the outside diameter of the screw flight. Subsequently, one solution to the uneven wear problem was proposed in U.S. Pat. No. 4,089,466. The aforementioned disadvantages were overcome by the use of tantalum carbides. But shortly thereafter, an upward fluctuation in the cost of tantalum carbide made it economically impractical to manufacture such a carbide bearing alloy. These disadvantages were in turn overcome by using a mixture of vanadium carbide, tungsten carbide and tantalum carbides in the alloy as was taught by U.S. Pat. No. 4,399,198. The use of multiple carbides resulted in substantially uniform carbide concentration throughout the lining thickness. The use of multiple carbides generally solved the differential concentration problem inherent in the single tungsten carbide alloy, yet created other problems. For instance, the carbides, depending on the density, segregate into different layers, though the overall carbide concentration was uniform throughout the lining thickness (See FIG. 3 and FIG. 4). This posed machining problems, especially whenever a counterbore needed to be machined through the bimetallic cylinder. Another problems in that a significant portion of lighter carbides such as titanium carbide and vanadium carbide were dispersed in hone stock layer during the casting operation. This resulted in low volume percent (up to 20%) of carbides in the finished machine alloy. The hardness of the multiple carbide alloy is two to three Rockwell points lower than original tungsten carbide alloys.

It is therefore a primary object of the present invention to provide superior wear and corrosion resistant multiple carbide alloy.

Another object of this present invention is to provide a cylinder containing a multitude of carbides of different densities and morphologies, yet substantially evenly dispersed through each strata of lining thickness.

SUMMARY OF THE INVENTION

The present invention relates to alloys having substantially uniform aggregate distribution and the cylinders centrifugally cast therefrom, and the method related to the production of such alloys and cylinders.

The alloys of the present invention are prepared bY providing a casting mixture having what shall be referred to as a metallic component and an aggregate component.

The aggregate component comprises a combination of aggregates of the carbides of all three of the metals, tungsten, titanium and vanadium. Such aggregates are formed by the combination of the metal carbide with at least one other element. Examples of such aggregates include tungsten carbide/cobalt aggregate; titanium carbide/nickel-chromium-tungsten-molybdenum aggregate; and vanadium carbide/tungsten carbide aggregate. It is preferred that such aggregates be presintered or prealloyed.

The multiple aggregates used in accordance with the present invention should be selected with regard to their carbide content, aggregating material content, density and morphology such that the multiple carbides in a given application will respond to the casting method of that application so as to be substantially uniformly distributed throughout the alloy. For instance, in centrifugal casting, the multiple aggregates should be selected so that they will become substantially uniformly distributed through the centrifugally cast alloy.

The metallic component of the alloy is comprised of at least one metal or combination of metals as desired. Such metallic component may comprise such metals as nickel, chromium, tungsten, molybdenum, copper, iron and/or combinations thereof The metallic component may also contain such non-metallic substances as carbon, silicon, and boron in accordance with practice known in the metallurgical arts.

The aggregate component used in accordance with the present invention is preferably present in an amount such that the total aggregate component content is in the range of from about 33% to about 43% by weight of the alloy. As an example, the one such aggregate component may comprise tungsten carbide/cobalt aggregate which is 85% tungsten carbide and 15% cobalt and which is added in an amount so as to achieve a tungsten carbide content in the resultant alloy in the range of from about 24% to about 29% by weight. The titanium carbide aggregate portion of the aggregate component is added in an amount so as to achieve a titanium carbide concentration in the alloy in the range of from about 3% to about 4% by weight. The titanium carbide aggregate is added in the form of a presintered and crushed aggregate which is 50% by weight and crushed aggregate which is 50% by weight titanium carbide and 50% nickel-chromium-tungsten-molybdenum alloy. The composition of such a nickel-chromium-tungsten-molybdenum alloy binder is provided in Table A. The vanadium carbide portion of the aggregate component is added so as to achieve a vanadium carbide content in the range of from about 6% to about 11% by weight of the resulting alloy. The vanadium carbide aggregate may be added in the form of a prealloyed aggregate containing 56% by weight vanadium carbide and 26% by weight tungsten carbide.

The weight percentage of the carbides in the initial load mixture together with the estimated final volume percentages of the carbides in the resulting alloy are given in Table B. It should be noted that even though the weight percent of the lighter carbides are lower, the volume percentage of these carbides are significantly higher in the finished machined alloy. The initial weight percentage and final estimated volume percentages of carbides in the similar alloys previously compounded are summarized in Table C.

Although not limited by the particular theory of the invention, it is thought that the preferred carbide aggregate mixture is one which substantially equalizes the density variations of the individual carbides, thus enabling carbides of different densities and morphologies to be suspended and distributed substantially uniformly through the resulting alloy. In the field of centrifugal casting, this effect results in the substantially uniform distribution of the carbides in each strata of lining thickness during the casting process. This effect can be seen in FIGS. 5 and 6.

DESCRIPTION OF THE PREFERRED EMBODIMENT

Figure 1:
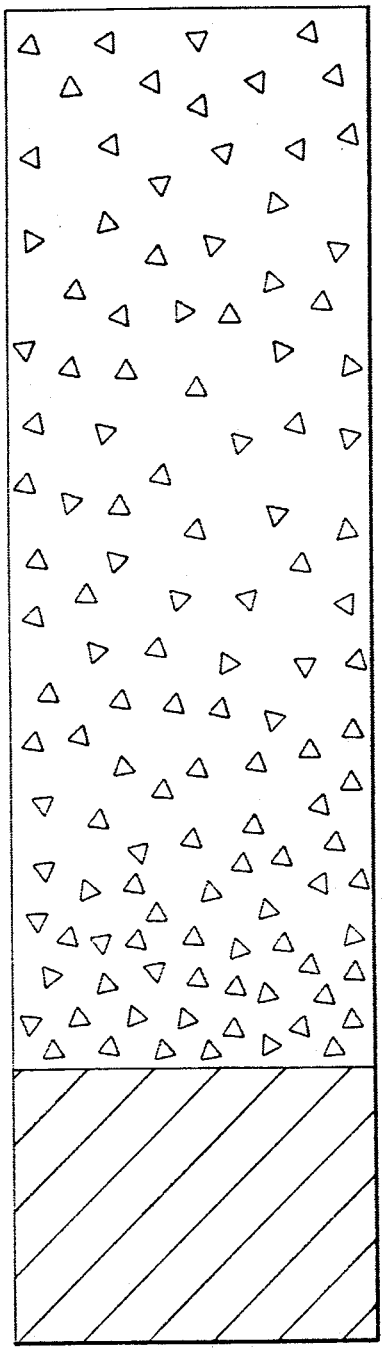
FIG. 1 (PRIOR ART)
FIG. 1 is a schematic drawing showing the differential distribution of carbides in single (Tungsten) carbide alloy.

In the preferred embodiment of the present invention, the metallic component of the alloy is a nickel-chromium matrix whose components, with corresponding weight percent ranges, are contained in Table D. The aggregate component comprises a combination of tungsten carbide/cobalt aggregate; titanium carbide/-nickel-chromium-tungsten-molybdenum alloy aggregate; and vanadium carbide/tungsten carbide aggregate. The nickel-chromium-tungsten-molybdenum binder alloy used in the aggregate with titanium carbide contains the ingredients, in the corresponding weight percent amounts, shown in Table A. The aggregate component used in the preferred embodiment contains the above-described three carbide aggregates present in the corresponding weight percent amounts listed in Table E. The composition of the nickel-chromium-tungsten-molybdenum binder alloy used in conjunction with the titanium carbide aggregate is given in Table A.

The preferred compositions of the carbide aggregates given in Table E are as follows. The tungsten carbide/-cobalt aggregate comprises preferably from about 82% to about 86.5% tungsten carbide and from about 13.5% to about 18% cobalt with the preferred aggregate being 85% tungsten carbide and 15% cobalt. The titanium carbide/nickel-chromium-tungsten-molybdenum alloy aggregate preferably comprises from about 40% to about 60% titanium carbide and from about 40% to about 60% nickel-chromium-tungsten-molybdenum alloy with the most preferred composition being 50% titanium carbide and 50% nickel-chromium-tungsten-molybdenum alloy. The vanadium carbide/tungsten carbide aggregate comprises preferably from about 42% to about 61% vanadium carbide and from about 21% to about 31% tungsten carbide; the most preferred embodiment comprising 56% vanadium carbide and 26% tungsten carbide with the balance being other material such as carbon, boron or silicon. It will be noted here that the vanadium carbide aggregate uses tungsten carbide as the binder material.

The preferred ranges for the weight percent compositions of the above carbide aggregates in the alloy mixture are such that the tungsten carbide is present in an amount from about 24% to about 29%; the titanium carbide is present in an amount from about 3% to about 4% and the vanadium carbide is present in an amount from about 6% to about 11%.

The method of making the alloys of the present invention comprises generally the steps of preparing a mixture of at least one metal (which may contain non-metallic substances) and is referred to collectively as the "metallic component" or the "matrix"; at least one tungsten carbide aggregate, at least one vanadium carbide aggregate and at least one titanium carbide aggregate, said aggregates having density and morphology characteristics such that they become substantially uniformly distributed throughout the mixture when molten. The next step of the method is to maintain the mixture at a temperature sufficient to allow said at least one metal (or the "metallic component" or the "matrix") and the aggregates to be fused together. The mixture is maintained at such temperature for a sufficient time to allow the aggregates to be substantially uniformly distributed throughout the mixture. The mixture can then be cast into an alloy in the desired shape. One of the specific applications of the present invention is in the area of centrifugal casting. This specific method comprises generally the steps of preparing a mixture of a "metallic component" or "matrix" which contains at least one metal together with at least one tungsten carbide aggregate at least one vanadium carbide aggregate and at least one titanium carbide aggregate; and maintaining this mixture at a temperature sufficient to allow the "metallic component" and said aggregate to be fused together; and centrifugally casting said mixture for a time sufficient to allow the aggregates to be substantiallY uniformly distributed throughout the mixture and to allow said mixture to be formed into an alloy member having a substantially tubular shape.

Also part of the present invention are the centrifugally cast members prepared in accordance with the centrifugal casting method of the present invention.

RESULTS

The following figures compare the results obtained with methods used in the prior art to the obtained with the method of the present invention. These figures are schematics or photomicrographs of cross sections of centrifugal castings obtained by the various methods.

Figure 2:
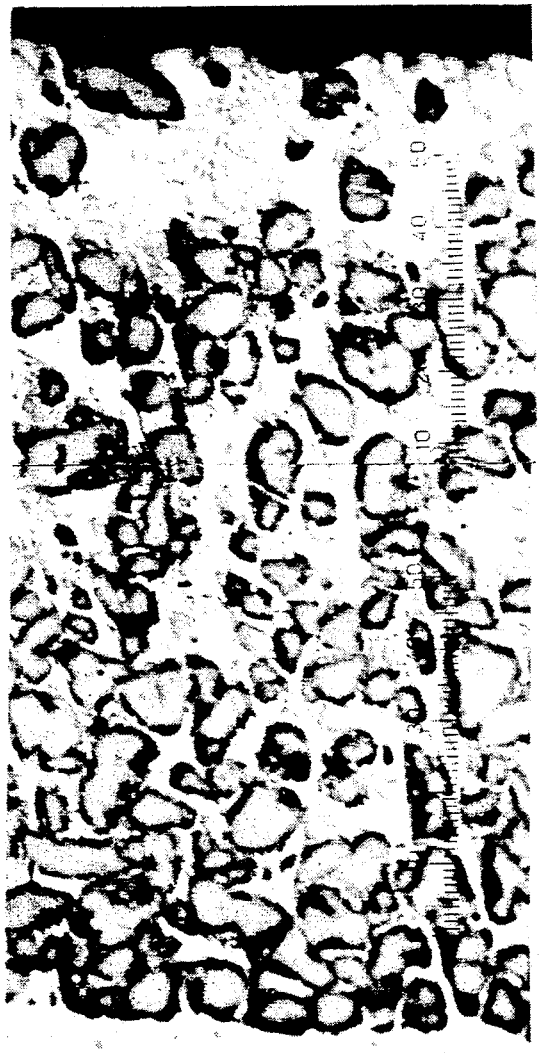
FIG. 2 (PRIOR ART)
FIG. 2 is a photomicrograph showing the carbide distribution in single carbide alloy (i.e., Tungsten).

FIGS. 1 and 2 are a schematic and a photomicrograph, respectively, showing the differential distribution of carbides in a single carbide alloy (i.e. tungsten carbide alloy). These figures show how the carbides are distributed unevenly with greater amounts of the carbide occurring toward the outside of the centrifugal cast (i.e.) at the bottom of FIGS. 1 and 2). This is due to the relatively high density of tungsten carbide vis-a-vis the Matrix metallic component.

Figure 3:
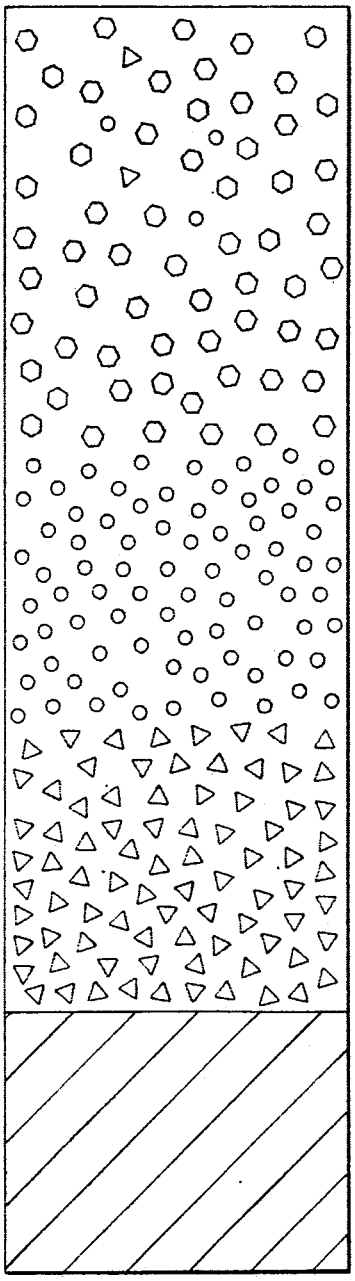
FIG. 3 (PRIOR ART)
FIG. 3 is a schematic drawing showing the differential segregation of carbides in multicarbide alloy.
Figure 4:
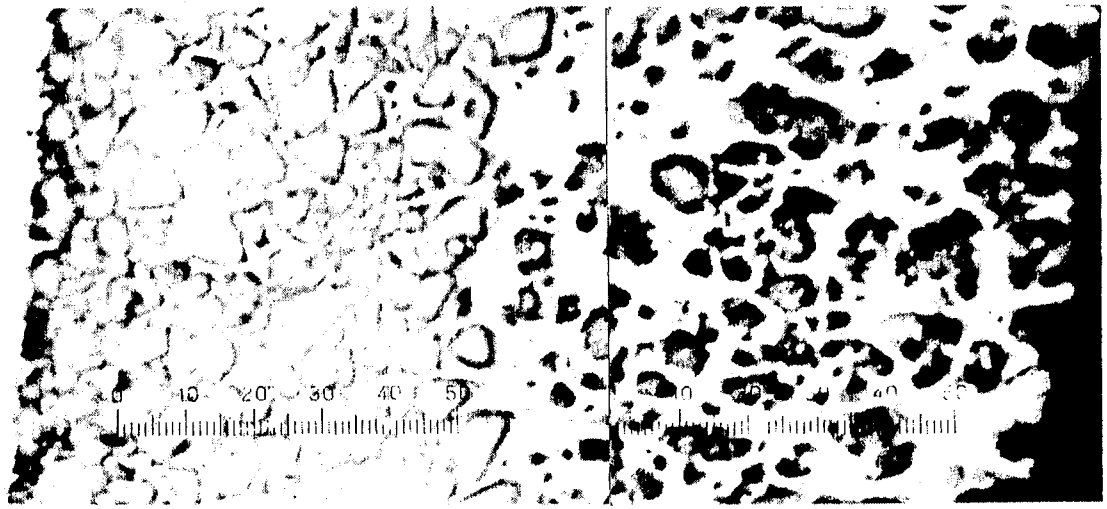
FIG. 4 (PRIOR ART)
FIG. 4 is a photomicrograph showing the carbide distribution in multicarbide alloy.

FIGS. 3 and 4 are a schematic and photomicrograph, respectively, of a multiple carbide alloy achieved as the result of a prior art method such as that shown in U.S. Pat. No. 4,399,198. These figures show the differential segregation of three different carbides (i.e. tungsten, titanium and vanadium carbides) which occurs as a result of the carbides' differing behavior during the centrifugal casting. In these figures it will be noted that the tungsten carbide occurs toward the outside of the casting cross-section; the titanium carbide occurs toward the middle of the casting cross section; and the vanadium carbide occurs mostly toward the inside of the casting cross section. This effect is thought to be a consequence of the differing densities and morphologies of the various carbides causing differing behavior vis-a-vis one another and the metallic matrix.

Figure 5:
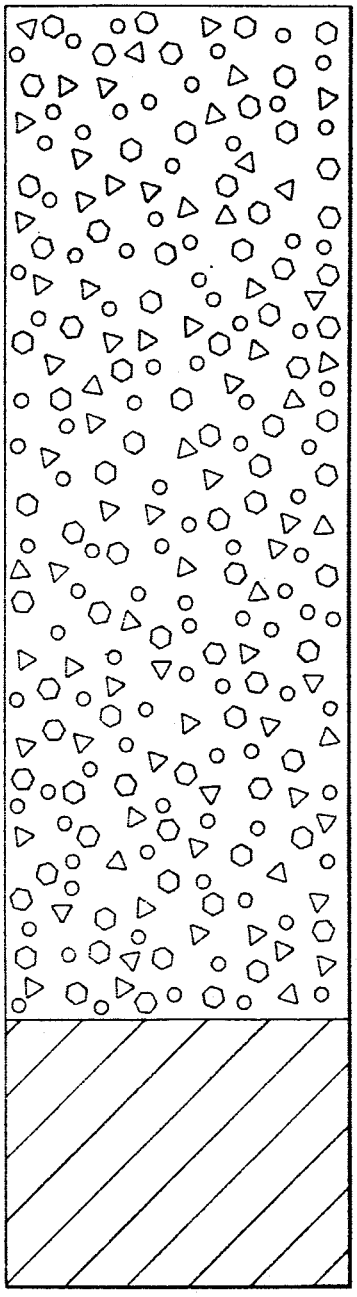
FIG. 5 is a schematic drawing showing the uniform distribution of carbides in multicarbide alloy of the present invention.
Figure 6:
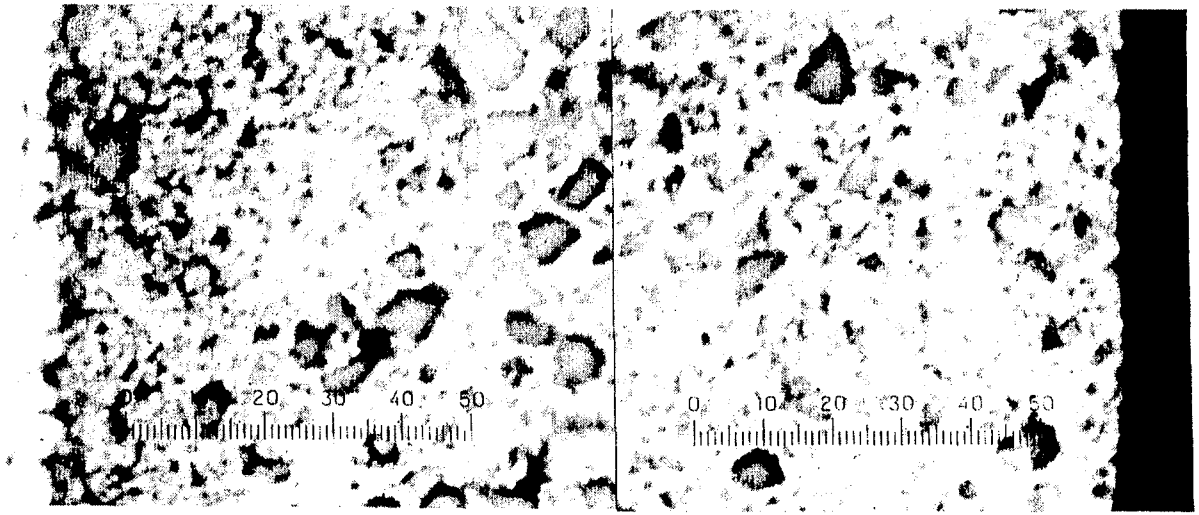
FIG. 6 is a photomicograph showing the uniform distribution of carbides in multicarbide alloy of the present invention.

The improved results of the present invention are shown in FIGS. 5 and 6 which are a schematic and a photo micrograph, respectively, showing the uniform distribution of the aggregated carbides in a multicarbide alloy. In these figures, it can be seen that the distribution of the three carbide aggregates is substantially uniform throughout the cross section of the centrifugal casting. Although not limited by theory, this is thought to be a result of the more uniform density or morphology parameters occasioned by the aggregation of each of the carbides with a binder material. In this regard, it is thought that the use of a relatively heavier binding material with the relatively lighter carbides (such as the use of tungsten carbide as a binder with vanadium carbide) render the resulting aggregates relatively similar in density which in turn leads to substantially uniform behavior (and therefore substantially uniform distribution) in the centrifugal casting. Accordingly, the present invention in its most general form comprises a fused mixture of (1) at least one matrix metal comprising a nickel-chromium alloy, (2) at least one aggregate of tungsten carbide with at least one other material, (3) at least one aggregate of vanadium carbide with at least one other material, and (4) at least one aggregated of titanium carbide with at least one other material wherein said materials are selected such that the carbide aggregates become substantially uniformly distributed throughout the alloy during the casting process.

The result of the method of the present invention is a multicarbide alloy having more uniform wear and hardness characteristics as well as having beneficial corrosion resisting qualities.

Modifications and variations to the present invention may be made in light of the foregoing disclosure without departing from the inventions spirit.

Generally they are achieved by providing a total 33–43 weight percent of combination of tungsten, titanium and vanadium carbides. Tungsten carbide in the range of 24–29 weight percent is added in the form of 85 percent tungsten carbide - 15 percent cobalt aggregate. The titanium carbide in the range of 3 to 4 weight percent is added in the form of presintered and crushed 50 weight percent titanium carbide, 50 weight percent nickel-chromium-tungsten-molybdenum alloy. The composition of nickel-chromium-tungsten-molybdenum alloy binder is provided in Table A. The vanadium carbide in the range of 6 to 11 weight percent is added in the form of prealloyed, 56 weight percent vanadium carbide, 26 weight percent tungsten carbide aggregate. The weight percentage of the carbides in the initial load and estimated final volume percentages of the carbides in the alloy are given in Table B. It should be noted that even though the weight percent of the lighter carbides are lower, the volume percentage of these carbides are significantly higher in the finish machined alloy. The initial weight percentage and final estimated volume percentages of carbides in the similar alloys previously patented are summarized in Table C.

It has been proposed (and substantiated by later experiments) that the preferred carbide aggregate mixture substantially equalizes the density variations of individual carbides, thus enabling carbides of different densities and morphologies suspended substantially uniform through each strata of lining thickness during the casting process (refer to FIG. 5 & FIG. 6).

DESCRIPTION OF THE PREFERRED EMBODIMENT

The nickel-chromium matrix alloy and carbide aggregate of the present invention may be selected from those alloys described in Tables D and E. The indicated ranges of weight percentages should not be considered as limiting, but rather approximate proportions.

A steel cylinder to be lined is bored 0.125 inch over the finished size and the preblended alloy of present invention is placed inside the cylinder cavity. The quantity of the alloy material is selected such that rough spun coating will be 0.080 0.110 thicker than the desired final coating.

The cylinder is then capped by welding the steel plates at the ends and heated in a gas fired furnace in the range of 2100° to 2200° F. The cylinder is then removed from the furnace and rapidly spun on rollers to centrifugally cast the alloy over the inside of the cylinder. The cylinder is cooled according to the standard practice by covering with insulating material.

The properties of the alloy according to the present invention are set forth as follows:

| | |
|---|---|
| Macro hardness of composite multi carbide alloy (after cast & rough machined) | 55–58 |
| Macro hardness of as cast matrix alloy | 47–51 |

This invention is an improvement over the alloy of U.S. Pat. No. 3,836,341, in that the present invention provides even distribution of carbides through the whole lining thickness as opposed to differentially distributed through the thickness. It is also an improvement over the alloy of U.S. Pat. No. 4,399,198, in that the photomicrograph shows that the alloy of present invention eliminates segregation of carbides of different densities and morphologies, by using prealloyed and presintered carbides. The hardness of the alloy of present invention is typically two to three points higher in Rockwell 'C' scale compared to the alloy of the invention in U.S. Pat. No. 4,399,198 as described in Example A. The details of unsuccessful casting, where the carbide mixture contained higher percentages of carbides than what has been set forth as optimum in Table E, is provided in Example B. Example C compares the machineability of the two cylinders, one cast as described in U.S. Pat. No. 4,399,198, and the other manufactured according to the present invention.

EXAMPLE A

Matrix alloy of 0.9 weight percent carbon, 16 weight percent chromium, 3.25 weight percent boron, 4.25 weight percent silicon, 4.50 weight percent iron, balance nickel was blended with 29 weight percent tungsten carbide/cobalt alloy aggregate, 3 weight percent titanium carbide/nickel-chromium alloy aggregate, 7 weight percent vanadium tungsten carbide and loaded inside 2 ½ inch ID×5 ½ inch OD×24 inch long steel cylinder and centrifugally cast according to standard practice.

The cylinder was rough machined and the hardness was checked. The hardness was found to be between 56 to 58 Rockwell 'c' scale, 2 to 3 Rockwell points above what is claimed in U.S. Pat. No. 4,399,198. A test ring was cut from the end of the cylinder and a metallographic sample was prepared according to standard practice. When the metallographic sample was examined under the microscope, the sample showed carbides of different types and morphologies substantially evenly distributed through the whole lining thickness. There was neither a differential distribution of carbides nor segregation of lighter and heavier carbides in the microstructure of the alloy (refer to FIGS. 5 & 6).

TABLE A

| COMPOSITION OF BINDER ALLOY | |
|---|---|
| Ingredient | Weight Percent |
| Carbon | 0.3 to 0.6 |
| Chromium | 14 to 17 |
| Silicon | 3 to 4.50 |
| Iron | 3 to 6.00 |
| Boron | 3.5 to 4.50 |
| Tungsten | 2 to 3.5 |
| Molybdenum | 2 to 3.5 |
| Copper | 1 to 3 |
| Nickel | Balance |

TABLE B

| CONVERTING WEIGHT PERCENT TO VOLUME PERCENT | | | | |
|---|---|---|---|---|
| | Carbide Type | | | |
| Wt. or Vol. Percent | Tungsten Carbide/ Cobalt Aggregate | Titanium Carbide Nickel-Chromium Aggregate | Vanadium/Tungsten Carbide Aggregate | Total |
| I. Alloy of Current Invention | | | | |
| Weight percent of aggregate (max/min) | 24–29 | 3–4 | 6–11 | 33–43 |
| Estimated density of carbide/alloy aggregate | 15.0 | 6.0 | 6.5 | — |
| Calculated volume percent of carbide alloy aggregate | 14/17 | 4.5/6.0 | 8/15 | 26.5/37 |
| Calculated volume percent of individual carbides | 10/13 | 2/3 | 8/15 | 20/31* |

*The amount of carbides in the finished honed lining will vary depending on the amount of carbide in the hone stock layer.

EXAMPLE B

Matrix alloy of 0.9 weight percent carbon, 16 weight percent chromium, 3.25 weight percent boron, 4.25 weight percent silicon, 4.50 weight percent iron, balance nickel was blended with 24 weight percent tungsten carbide/cobalt alloy aggregate, 6 weight percent titanium carbide/nickel-chromium-tungsten-molybdenum alloy aggregate, 13 weight percent vanadium tungsten carbide aggregate and loaded inside a 2.5 inch ID×5.5 inch OD×24 inches long steel cylinder and the alloy is centrifugally cast according to standard practice.

When the cylinder was decapped, the lining alloy appeared lumpy and porous. It shall be noted that the alloy in this example contained carbide percentages higher than what is set forth as optimum in Table E.

TABLE C

| CARBIDE PERCENTAGE OF ALLOYS OF PREVIOUS PATENTS | | | | |
|---|---|---|---|---|
| | Carbide Type | | | |
| Wt. or Vol. Percent | Tungsten Carbide | Titanium Carbide | Vanadium Carbide | Total |
| I. Alloy of Patent #4,399,198 | | | | |
| Weight percent Max. | 9.00 | 3.00 | 15 | — |
| Estimated Density | 16.00 | 4.40 | 5.25 | — |
| Calculated Volume Percent, Max. | 4.00 | 5.00 | 22 | 31* |
| II. Alloy of Patent #4,399,198 | | | | |
| Weight Percent Max. | 45 | | | |
| Estimated Density | 15.5 | | | |
| Volume Percent, Max. | 29* | | | |

*The amount of carbides in the finished honed lining will vary depending on the amount of carbide in the hone stock layer.

EXAMPLE C

A cylinder 2.5 inch ID×5.5 inch OD×24 inches long was manufactured according to the invention U.S. Pat. No. 4,399,198. A counterbore one inch deep and 0.5 inch wide was machined using regular carbide tool, with ⅛ inch deep cut at 9 rpm. It took not only about 3 hrs. to machine the counterbore, but also resulted in excessive tool wear.

A counterbore one inch deep and 0.5 inch wide was machined using the same type of tool in the cylinder manufactured according to the current invention (cylinder in Example A). It took only about thirty minutes to machine the counterbore; also, the tool wear was minimum.

TABLE D

| NICKEL-CHROMIUM MATRIX ALLOY | |
|---|---|
| Ingredient | Weight Percent |
| Carbon | 0.3 to 0.7 |
| Chromium | 10 to 18 |
| Boron | 2 to 4.5 |
| Silicon | 2 to 4.5 |
| Iron | 3 to 6.0 |
| Tungsten | Up to 3.5 |
| Molybdenum | Up to 3.5 |
| Copper | Up to 3.0 |
| Nickel | Balance |

TABLE E

| CARBIDE AGGREGATE | |
|---|---|
| Carbide/Alloy Aggregate | Weight Percent |
| Tungsten Carbide/Cobalt | 24–29 |
| Titanium Carbide/Nickel-Tungsten-Molybdenum Aggregate | 3–4 |

TABLE E-continued

| CARBIDE AGGREGATE | |
|---|---|
| Carbide/Alloy Aggregate | Weight Percent |
| Combined Vanadium Tungsten Carbide Aggregate | 6–11 |

What is claimed is:

1. A hard wear and corrosion resistant alloy comprising a fused mixture of at least one matrix metal comprising a nickel-chromium alloy, at least one aggregate of tungsten carbide and at least one other first material, at least one aggregate of vanadium carbide and at least one second material, and at least one aggregate of titanium carbide and at least one third material, said at least one first material, said at least one second material and said at least one third material being such as to cause, said carbide aggregates to be substantially uniformly distributed throughout said alloy during the casting of said alloy.

2. A hard wear and corrosion resistant alloy according to claim 1 wherein said alloy is in the form of a centrifugally cast member.

3. A hard wear and corrosion resistant alloy according to claim 1 wherein said carbide aggregates are tungsten carbide/cobalt aggregate comprising from about 82% to about 86.5% tungsten carbide and from about 13.5% to about 18% cobalt; titanium carbide/nickel-chromium-tungsten-molybdenum m alloy aggregate comprising from about 40% to about 60% titanium carbide and from about 40% to about 60% nickel chromium tungsten-molybdenum alloy; and vanadium carbide/tungsten carbide aggregate comprising from about 42% to about 61% vanadium carbide and from about 21% to about 31% tungsten carbide.

4. A hard wear and corrosion resistant alloy according to claim 1 wherein said carbide aggregates are tungsten carbide/cobalt aggregate comprising 85% tungsten carbide and 15% cobalt; titanium carbide/nickel-chromium-tungsten-molybdenum m alloy aggregate comprising 50% titanium carbide and 50% nickel chromium tungsten-molybdenum alloy; and vanadium carbide/tungsten carbide aggregate comprising 56% vanadium carbide and 26% tungsten carbide.

5. A hard wear and corrosion resistant alloy having a metallic component and a aggregate component wherein said metallic component comprises the following materials in the weight percent composition ranges as follows:

| Material | Weight Percent of Metallic Component |
|---|---|
| Carbon | From about 0.3% to about 0.7% |
| Chromium | From about 10% to about 18% |
| Boron | From about 2% to about 4.5% |
| Silicon | From about 2% to about 4.5% |
| Iron | From about 3% to about 6.0% |
| Tungsten | From about 0% to about 3.5% |
| Molybdenum | From about 0% to about 3.5% |
| Copper | From about 0% to about 3.0% |

and wherein the balance of said metallic component is nickel; and wherein said aggregate component comprises aggregates of the following carbides such that said carbides are present in said alloy in the following weight percent composition ranges:

| Carbide | Weight Percent Range in Alloy |
|---|---|
| Tungsten | From about 24% to about 29% |
| Titanium | From about 3% to about 4% |
| Vanadium | From about 6% to about 11% |

* * * * *